US007810668B2

(12) United States Patent
Van De Klippe et al.

(10) Patent No.: US 7,810,668 B2
(45) **Date of Patent: *Oct. 12, 2010**

(54) CLOSURE PLUG WITH IMPROVED GASKET SEAT

(75) Inventors: Cornelis R. Van De Klippe, West Chicago, IL (US); Herman P. Kars, Carol Stream, IL (US)

(73) Assignee: Greif International Holding BV (NL)

( * ) Notice: Subject to any disclaimer, the term of this patent is extended or adjusted under 35 U.S.C. 154(b) by 134 days.

This patent is subject to a terminal disclaimer.

(21) Appl. No.: 11/923,163

(22) Filed: Oct. 24, 2007

(65) Prior Publication Data

US 2008/0087670 A1 Apr. 17, 2008

Related U.S. Application Data

(63) Continuation of application No. 10/894,082, filed on Jul. 20, 2004, now Pat. No. 7,287,662.

(30) Foreign Application Priority Data

Nov. 18, 2002 (GB) ..... 0226866

(51) Int. Cl.
*B65D 39/08* (2006.01)
*B65D 53/00* (2006.01)

(52) U.S. Cl. ..... 220/304; 220/601; 215/356

(58) Field of Classification Search ..... 220/304, 220/661, 601, DIG. 33, 254.1, 254.8; 217/110, 217/113, 98; 215/356; 138/89.96 T; 277/628, 277/616, 602

See application file for complete search history.

(56) References Cited

U.S. PATENT DOCUMENTS

| | | | |
|---|---|---|---|
| 1,478,918 | A | 12/1923 | Rupp |
| 1,964,603 | A | 6/1934 | Shera |
| 2,328,696 | A | 9/1943 | Voglesong |

(Continued)

FOREIGN PATENT DOCUMENTS

| | | |
|---|---|---|
| DE | 880413 | 6/1953 |

(Continued)

OTHER PUBLICATIONS

International Search Report dated May 23, 2003, 2 pages.

*Primary Examiner*—Robin Hylton
(74) *Attorney, Agent, or Firm*—Baker & Hostetler LLP

(57) ABSTRACT

An externally threaded closure plug for tightly closing off the internally threaded opening in shipping and storage containers such as drums, pails and the like. The plug is formed as a cup having a bottom wall and threaded cylindrical sidewall terminating in a circumferentially enlarged rim. Immediately beneath the rim of the plug is a gasket seat defined by the undersurface of the plug rim, the plug sidewall and an annular gasket retaining lip lying in a plane parallel to the undersurface of the plug rim. In use, the plug is screwed into and out of a container wall opening, having an internally threaded portion and an unthreaded portion, the sealing gasket being compressed between the unthreaded opening portion and the plug gasket seat and lying in close proximity to the internal thread. The gasket seat acts to prevent interengagement of the sealing gasket and the opening internally threaded portion.

18 Claims, 4 Drawing Sheets

U.S. PATENT DOCUMENTS

| | | | | |
|---|---|---|---|---|
| 2,906,429 | A | 9/1959 | Marchyn | |
| 3,070,254 | A | 12/1962 | Carse et al. | |
| 3,203,576 | A | 8/1965 | Wout et al. | |
| 3,255,916 | A | 6/1966 | Rice | |
| 3,276,617 | A | 10/1966 | Rempt | |
| 4,005,799 | A | 2/1977 | Mannaerts | |
| 4,117,949 | A | 10/1978 | Dwinell | |
| 4,768,677 | A | 9/1988 | Kitsukawa | |
| 4,787,528 | A | 11/1988 | Harris et al. | |
| 5,211,304 | A | 5/1993 | Stolzman | |
| 6,206,219 | B1 | 3/2001 | Brüggenolte | |
| 7,287,662 | B2 * | 10/2007 | Van De Klippe et al. | 220/304 |
| 2002/0125205 | A1 | 9/2002 | Hathaway et al. | |

FOREIGN PATENT DOCUMENTS

| | | | |
|---|---|---|---|
| DE | 4440852 | | 6/1996 |
| DE | 4440852 | C1 | 6/1996 |
| DE | 2021E8103 | | 4/2004 |
| DE | 20215810 | U1 | 4/2004 |
| EP | 0806369 | | 11/1997 |
| EP | 0806369 | A1 | 11/1997 |
| EP | 1467922 | A1 | 7/2003 |
| GB | 724263 | | 2/1955 |
| GB | 945663 | | 1/1964 |
| GB | 1264666 | | 2/1972 |
| GB | 1326874 | | 8/1973 |
| GB | 0226866.2 | | 11/2002 |
| JP | 2001146246 | A | 5/2001 |
| WO | WO 02/48884 | A1 | 6/2002 |

* cited by examiner

CLOSURE PLUG WITH IMPROVED GASKET SEAT

CROSS-REFERENCE TO RELATED APPLICATIONS

This application claims priority to and is a continuation of U.S. patent application Ser. No. 10/894,082, filed Jul. 20, 2004, now U.S. Pat. No. 7,287,662 the disclosure of which is hereby incorporated by reference in its entirety.

BACKGROUND OF THE INVENTION

This invention is directed to an improved container closure plug and more specifically a threaded plug having a unique gasket retaining feature.

In the shipping container industry it is most common to manufacture drums, pails and the like with one or more dispensing and/or fill openings. Such openings have an internal helical screw thread which merges into an unthreaded gasket sealing area. An externally threaded closure plug carrying an annular sealing gasket is threadedly engaged within the opening. Upon tightening the plug, the plug gasket is drawn down tightly against the unthreaded gasket sealing area to provide an effective sealing of the container. While many millions of drums and other containers have been sealed in this fashion, an occasional problem arises which this invention addresses. That problem has not only to do with sealing but also with unscrewing of the plug from the container opening. A critical relationship exists between the plug and its gasket on the one hand and the merger of the container opening thread into the opening gasket seat area on the other. This relationship is such that in practice upon applying the necessary torque to seal the plug in the container opening, the plug gasket becomes wedged against the run-out of the opening internal thread. When the plug is subsequently unscrewed it is an all to common occurrence that this gasket wedging action against the opening thread tightly grips the plug gasket. As the unscrewing action continues a tenuous condition ensues. Most notably as the plug travels out of the opening the gasket can remain ensnared on the internal opening thread so that the gasket gets pulled off of its gasket seat position on the plug. Continued rotation of the plug becomes extremely difficult as the gasket jams between the mating threads. Moreover, the gasket itself becomes severely damaged due to this shredding action which further diminishes the utility of the closure.

Another negative aspect of this gasket gripping condition is the tendency of the gasket to loop out of its gasket seat during torquing of the plug. This problem occurs when the plug gasket movement around the unthreaded gasket seat of the opening becomes obstructed causing the gasket to bunch up and form a loop protruding from the edge of the opening. One way for such obstruction to occur is when the plug gasket again becomes ensnared on the opening thread run-out as the plug now is travelling into the opening. The resultant "looping" condition will most certainly create a leakage path and quite likely impart serious damage to the gasket. The commonality between these "gripping" and "looping" problems is, of course, the ability to retain the plug gasket in place on the plug gasket seat where it belongs and thus prevent it from being dragged onto the thread interengagement.

The prior art has recognized the desirability generally of providing some positive mechanical retaining means for keeping the plug gasket in place. For example, U.S. Pat. No. 5,211,304 to Stolzman discloses a plug construction wherein the gasket is securely retained on the undersurface of the plug rim with a mechanical interlocking arrangement. This arrangement, however, places the gasket radially outwardly of the plug thread and has no relationship whatsoever to any kind of gasket "gripping" or "looping" problem. Another prior art example is found in U.S. Pat. No. 2,906,429 to Marchyn which recognizes the "looping" problems but fails to provide a completely satisfactory solution. In this patent the plug has a special thread formation where the thread borders the gasket seat. Specifically the plug has a diminishing thread that continues around the lower edge of the gasket seat and acts as a partial barrier above the normal plug thread. This modified thread configuration, however, falls short of providing adequate protection against the "gripping" phenomenon as will be clearly seen hereinafter.

BRIEF SUMMARY OF THE INVENTION

According to the present invention, a closure plug is formed with a cylindrical sidewall having a helical screw thread and terminating in a circumferentially enlarged rim and an annular gasket seat immediately under the plug rim, wherein a continuous circumferential radially outwardly extending gasket retaining lip is interposed between the plug gasket seat and the sidewall thread.

According to an embodiment of the present invention, the gasket retaining lip is in substantial axial alignment with the screw thread root diameter.

According to another embodiment of the present invention, the gasket retaining lip has a radial extension less than the outside radial extension of the crest of sidewall thread and an inner root diameter less than the root thread diameter.

According to a variant of this another embodiment, the gasket seat flares radially outwardly and upwardly to meet the rim.

According to another variant of this another embodiment, a gasket seat is provided with a peripheral groove at the root of the gasket retaining lip.

According to a further aspect of the present invention, a sealing gasket is positioned on gasket seat. The sealing gasket may be resilient and stretched over the plug so as to hug the gasket seat. With a closure plug in accordance with said variant of this another embodiment, the sealing gasket assumes the shape of the flared seating gasket.

Also according to the present invention, a closure plug is combined with a container wall opening, having an internally threaded portion and an unthreaded portion, the sealing gasket being compressed between the unthreaded opening portion and the plug gasket seat and lying in close proximity to the internal thread, wherein a continuous circumferential radially outwardly extending gasket retaining lip is interposed between the plug gasket seat and the sidewall thread to prevent interengagement of the sealing gasket and the opening internally threaded portion; whereby unimpeded unscrewing of the plug and sealing gasket as an undisturbed unit is effected.

A closure plug in accordance with the present invention provides a long sought after solution to the above mentioned "gripping" and "looping" problems in a simple straightforward manner.

In an example, the closure plug is formed with a cylindrical threaded sidewall and a disc like bottom wall. The sidewall terminates in a circumferentially enlarged rim and has an annular gasket seat immediately under the rim. Interposed between the plug gasket seat and the sidewall thread is the gasket retaining lip. The resilient sealing gasket is stretched over the plug gasket seat occupying the vertical space between the plug rim and the retaining lip. The above described plug is screwed into a container wall opening having an internal screw thread and an inwardly facing gasket sealing area. The prior art critical relationship existing between the plug gasket and the container opening thread now becomes quite inconsequential. As the plug is backed out of the threaded container opening the gasket is firmly held in place on the plug gasket seat by the gasket retaining lip. The resulting clean separation of the plug gasket from the container opening constitutes a significant improvement over the prior art.

It is accordingly a principal feature of the invention to provide an improved threaded closure plug for industrial size containers.

A further feature is to provide a threaded closure plug having a new and improved gasket seat construction.

A more detailed feature is to provide a plug gasket seat with structure to positively retain the plug gasket thereon during screwing and unscrewing.

Further and more detailed features will in part be apparent and in part pointed out as the description of the invention taken in conjunction with the accompanying drawing proceeds.

The above and further features of the present invention are set forth in the appended claims and are further described in the drawings wherein:

DETAILED DESCRIPTION OF THE INVENTION

Figure 1:
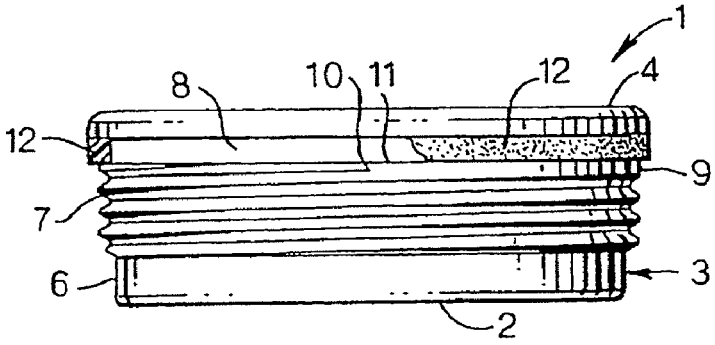
FIG. 1 is a part elevational part sectional view of a closure plug in accordance with one embodiment the invention.
Figure 2:
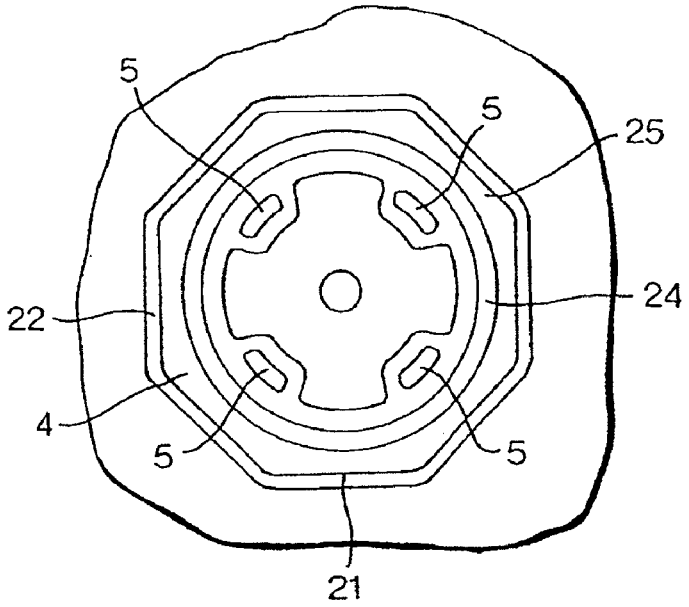
FIG. 2 is a top plan view of a container closure combination incorporating the closure plug of FIG. 1.

A closure plug, according to a first embodiment of the invention is illustrated in FIGS. 1 to 4 and is generally indicated at numeral 1, and is moulded from synthetic plastic resin to have a disc like bottom wall 2 surrounded by a cylindrical sidewall 3 terminating in a circumferentially enlarged rim 4. The interior of the plug 1 has a series of wrench engaging lugs 5 for imparting screwing and unscrewing torque to the plug. The plug sidewall 3 has a pilot portion 6 extending from the bottom wall 2, an external helical screw thread 7 and a gasket seat 8 positioned immediately below the plug rim 4. Here it is important to note that the gasket seat 8 lies in plane axially aligned with the plug thread root diameter. This relationship is beneficial in assuring a sufficient gasket volume between the plug and the mating container opening surface to close off any leakage path. The plug sidewall 3 is formed with a circumferential retaining lip 9 at the upper end of the thread 7 which extends radially outwardly in axial alignment with the thread crest. As clearly seen in FIG. 1 the plug thread runs out and terminates at the point 10 within the lip 9 leaving a uniform upwardly facing continuous annular surface 11 lying in a plane parallel to the undersurface 4*a* of the plug rim 4 and immediately above the thread termination 10. A resilient annular sealing gasket 12 having a substantially square cross sectional shape is stretched over the plug so as to hug the gasket seat 8. The gasket thus positioned is snugly clamped between the undersurface 4*a* of the plug rim 4 and the upper surface 11 of the retaining lip 9 making dislodgement of the gasket 12 from the gasket seat 8 quite unlikely.

Figure 3:
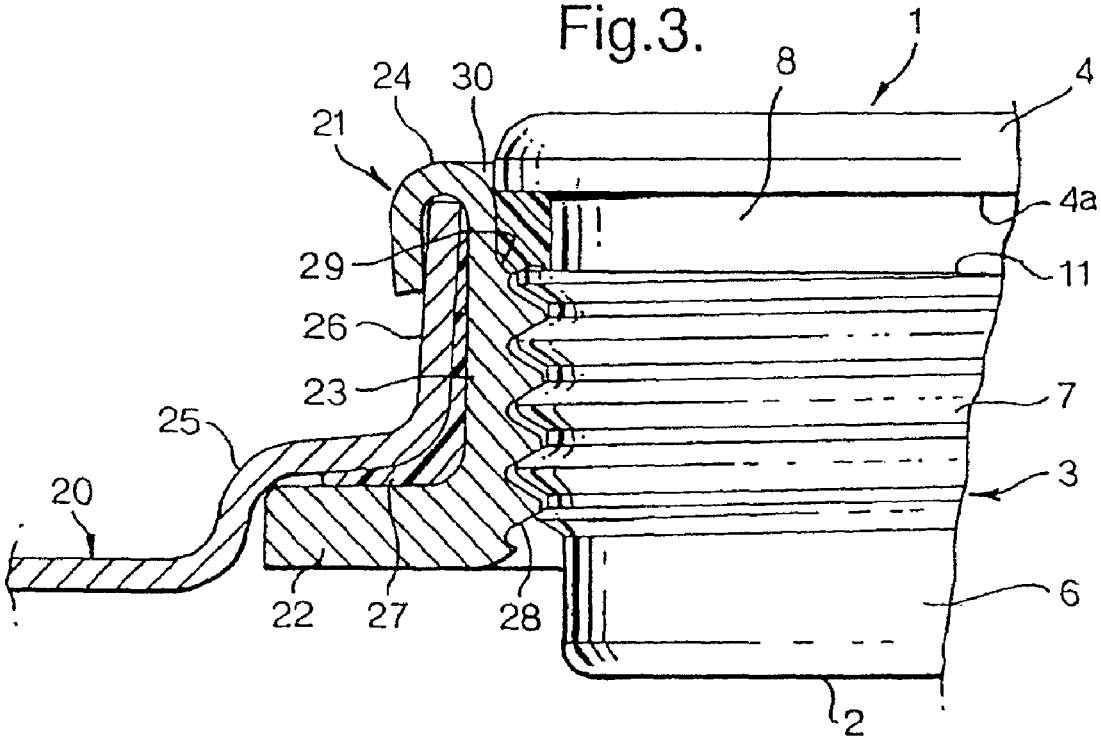
FIG. 3 is part sectional part elevational view of the plug of FIG. 1 screwed into the container opening.

The container wall opening within which the plug 1 is threadedly engaged as clearly shown in FIG. 3 consists of a container wall 20 within which a bushing generally indicated at numeral 21 is inserted in a conventional manner. The bushing 21 has a circumferentially extending polygonal base 22, a cylindrical wall 23 extending therefrom and terminating in a radially outwardly curled bead 24. The container wall 20 overlies the polygonal base 22 in a mating embossment 25 and has an upstanding substantially cylindrical neck 26 which extends within the bushing curl 24. A bushing gasket 27 is compressed between the bushing 21 and the surrounding surfaces of the container wall 20. An internal helical screw thread 28 is formed on the bushing wall 23 extending from the base 22 to a thread run-out point 29 at the start of the bead 24. The upwardly extending unthreaded bead portion immediately above the thread run-out point 29 forms a smooth gasket sealing area 30.

Figure 4:
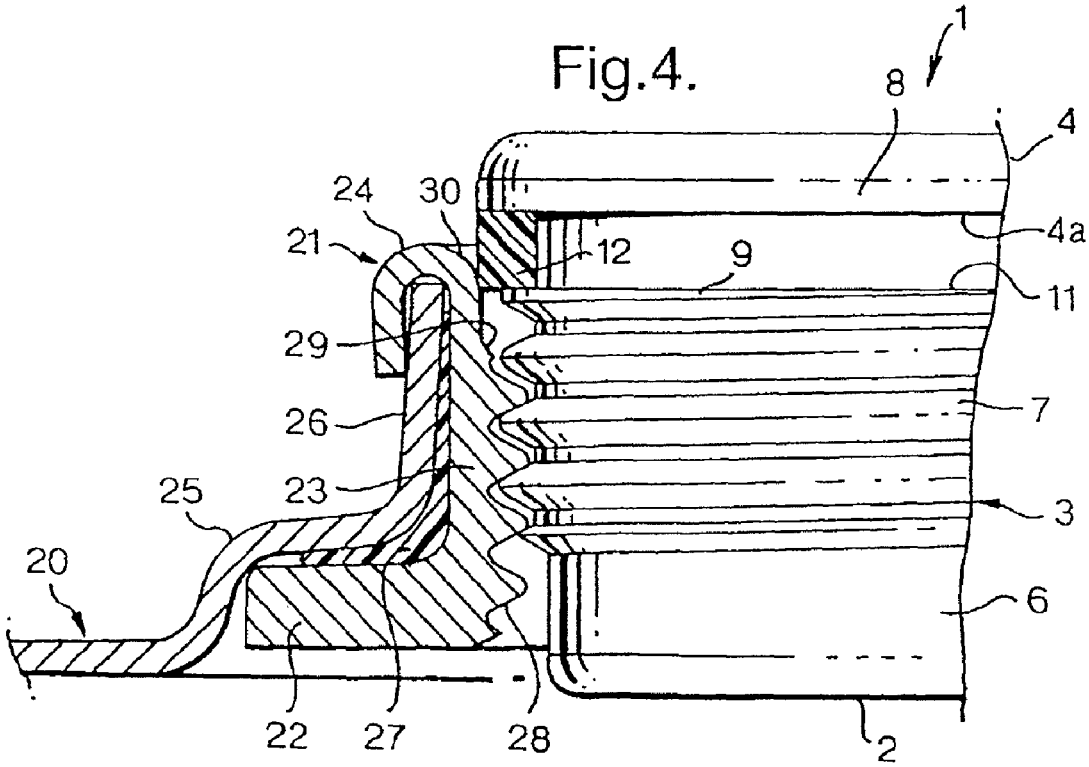
FIG. 4 is a view similar to FIG. 3 but with the plug in partially unthreaded position.

The sealing relationship between the plug 1 and bushing 21 in fully torqued condition as depicted in FIG. 3 shows the plug gasket 12 tightly compressed between the plug gasket seat 8 and the bushing sealing area 30. Quite noticeably the gasket 12 is also axially restrained between the rim undersurface 4*a* and the upper surface 11 of the retaining lip 9. Moreover it can be seen that the gasket 12 in this tightened position lies in contact with the bushing thread helical run-out and termination point 29. The continuous annular upper surface of the retaining lip maintains a constant axial spacing from the rim under surface 4*a* and prevents the gasket 12 from at any point becoming ensnared in the bushing thread 28. Upon unscrewing of the plug as shown in FIG. 4, the gasket retaining lip 9 very clearly lifts the plug gasket 12 away from the bushing thread 28 and up off of the gasket sealing area 30. It is due to this clean separation of the plug gasket from the surrounding bushing surfaces that the heretofore common gasket "gripping" and gasket "looping" problems have been eliminated.

Figure 5:
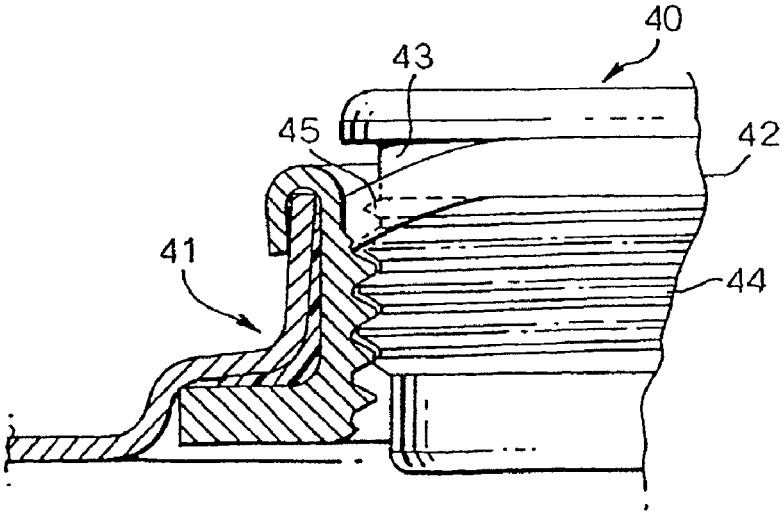
Fig.5. PRIOR ART
FIG. 5 is a view similar to FIG. 4 illustrating the prior art.

FIG. 5 in contrast shows a typical prior art condition wherein a prior art plug 40 is unscrewed from an internally threaded container wall opening neck 41. Here the plug gasket 42 sits on the gasket seat 43 formed at the root diameter of the plug thread but the plug thread 44 simply diminishes indicated by numeral 45 as it approaches the gasket seat 43. Under these prior art conditions it can be seen that as the plug is backed off, the gasket 42 has almost no axial support supplied by the diminished thread 45. As a result the gasket becomes easily ensnared between the interengaging closure threads and is pulled off the gasket seat creating a serious obstruction to normal closure functionality.

Figure 6:
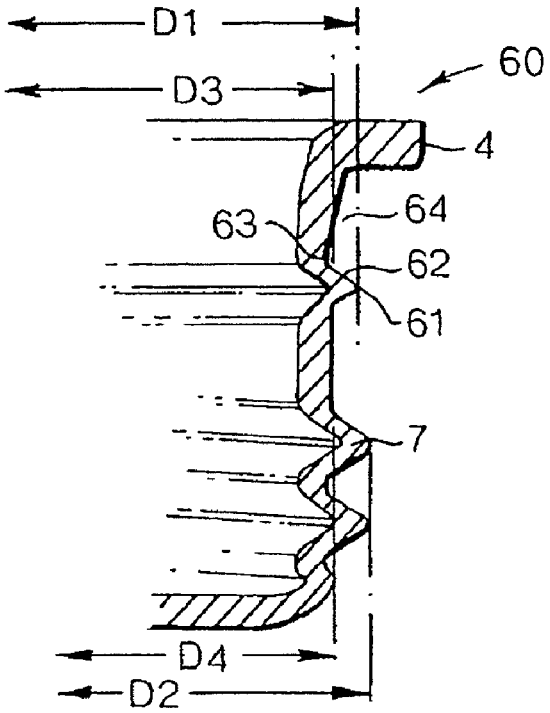
FIG. 6 is a part section detail of a closure plug in accordance with a second embodiment of the invention.
Figure 7:
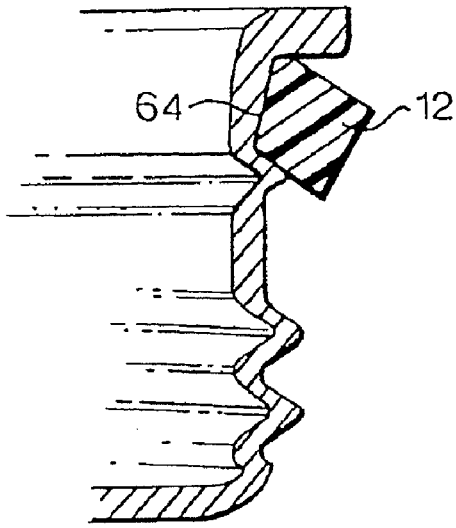
FIG. 7 is a view similar to FIG. 6 and including a sealing gasket.

Second and third embodiments of the invention are illustrated in FIGS. 6-7 and 8-9 respectively and are variants of the first embodiment described with reference to FIGS. 1 to 4; like parts have been given like references. As shown in FIGS. 6 and 7, a metal closure plug 60 in an example is cut and rolled from 1.15 mm drum end steel. The gasket retaining lip 61 is rolled to have a triangular, thread-like, cross-section having an included angle of 55°, a radial extension D1 less than the outside radial extension D2 of the crest of thread 7 and to lie in a plane parallel to the undersurface 4*a* of the plug rim 4. The upper flank 62 of the retaining lip 61 forms a continuous peripheral upwardly and outwardly facing surface above the screw thread 7. The diameter D3 of the inner root 63 of the lip 61 is less than the thread root diameter D4. The gasket seat 64 flares radially outwardly and upwardly to meet the rim 4 at essentially the same point that gasket seat 8 meets the rim in the first embodiment. A conventional gasket 12, of E.P.D.M., black nitrile or P.E., is stretched onto the gasket seat 64 and assumes the same generally flared shape; as shown in FIG. 7.

The effect of the changed geometry in this second embodiment is that the lip 61 has essentially the same radial extension D1-D3 as lip 9 of the first embodiment and thus the gasket lifting and anti-grabbing and anti-looping functions of the first embodiment are retained. The reduced lip diameter enables the closure plug to fit a greater range of container openings. The flared gasket seat 64 has two advantages. Firstly it provides an increased volume for the sealing gasket 12 in the area between the closure plug lip 61 and the gasket sealing area 30 of the container closure bushing 21 and, secondly, the frusto-conic shape assumed by the stretched gasket 12 provides an increased area of contact between the gasket and the gasket sealing area 30 as the plug is being screwed into the bushing 21. The sealing gasket is "fed in" to the volume between the bushing sealing area 30 and plug seat 64, with the leading end of the gasket initially being subjected to lower (or even no) compression. Thus, advantageously, the initial contact band between the gasket and the closure bushing is partway up the side of the gasket. This is seen most clearly in FIGS. 8 and 9, in which the plug threads, rim and lip 61 have a similar geometry to the embodiment shown in FIGS. 6 and 7, but the plug is formed from a suitable plastics material. The effect of this increased area of contact and lower gasket leading end compression is to further mitigate against gasket looping during plug torquing.

Another advantage of the geometry used for the lip 61 is that it reinforces the plug, enabling the plug in FIGS. 6 and 7 to be formed from thinner gauge steel than used for prior art plugs, while still maintaining equivalent structural integrity.

Using standard gaskets, it is possible for the lip 61 to directly contact the closure bushing wall 23 in the region of the bushing thread run out 29 when the plug 60 is fully torqued home. An oversized gasket can be used to prevent such metal-to-metal contact if desired.

Figure 10:
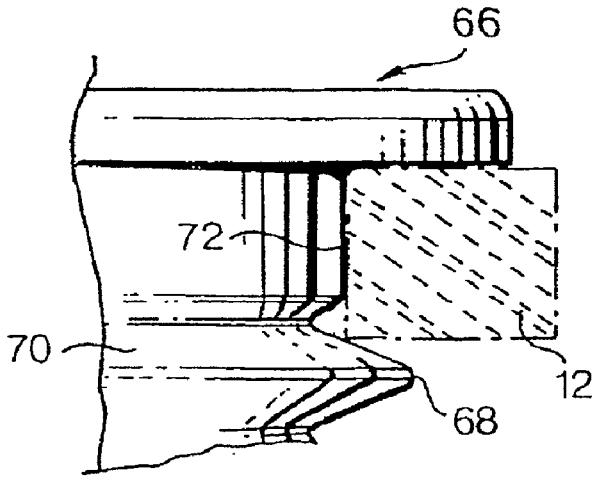
FIG. 10 is a part-section detail of a third embodiment of a closure plug in accordance with the invention.
Figure 8:
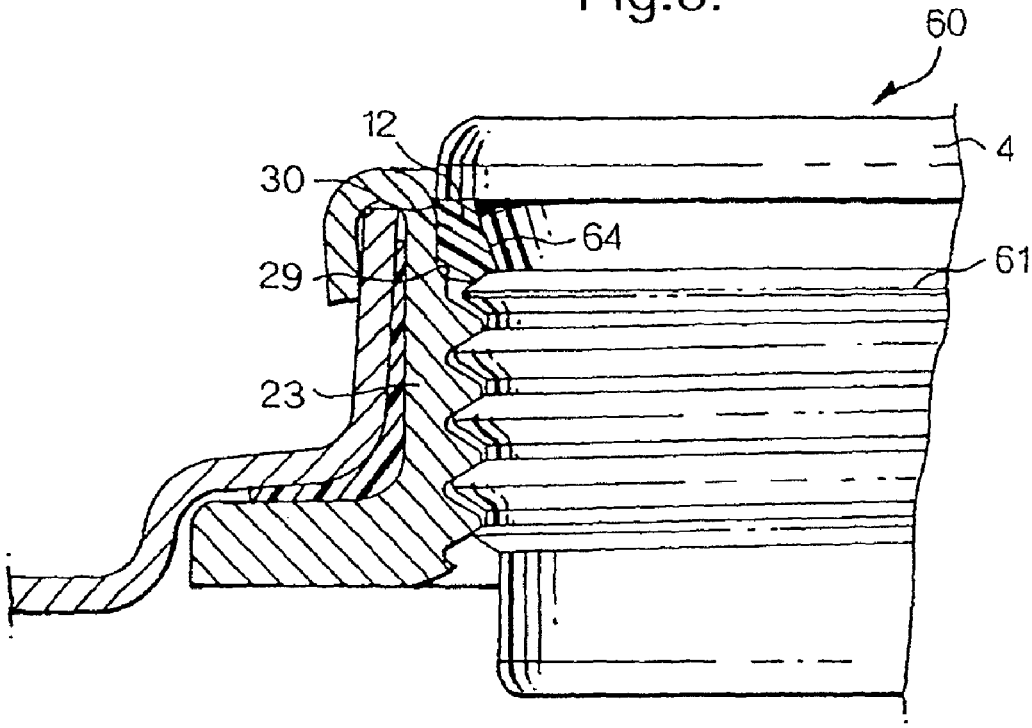
FIG. 8 is part sectional part elevational view of a closure plug forming a third embodiment of the invention, screwed into the container opening.
Figure 9:
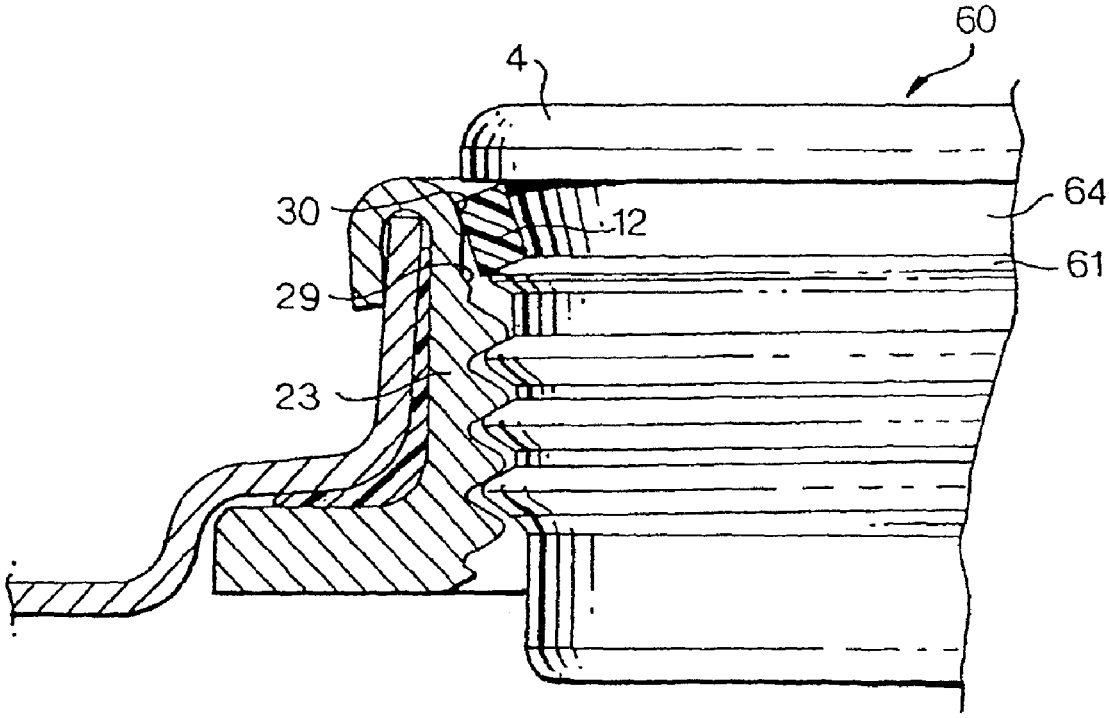
FIG. 9 is a view similar to FIG. 8, but with the plug in partially unthreaded position.

FIG. 10 illustrates a fourth embodiment of the invention, wherein a metal plug 66 has a lip 68 of the same geometry as lip 61 of the second embodiment. The difference is that a peripheral groove 70 is rolled in the gasket seat 72, at the root of lip 68, to leave the remainder of the gasket seat 72 cylindrical. This geometry provides the same radial extension for lip 68 as lips 9 and 61 of the first to third embodiments and the groove 70 provides an increased volume for the gasket 12.

Various changes in or modifications of the gasket retaining plug of the invention can be made. For example, the first embodiment closure plug could be formed from metal and the second and fourth embodiments moulded from synthetic plastic resin.

We claim:

1. A closure plug having a bottom end portion, comprising:

a cylindrical sidewall having an external helical screw thread;

an annular gasket retaining lip interposed between an annular plug gasket seat and the external helical screw thread, the annular gasket retaining lip having an inner root and an upper flank forming a continuous peripheral axially upwardly and radially outwardly facing annular surface above the external helical screw thread; and the annular gasket seat extending directly from the inner root radially outwardly and upwards in a direction away from the annular gasket retaining lip.

2. The closure plug of claim 1, wherein the annular gasket seat is a circumferentially frusto-conic surface.

3. The closure plug of claim 1, wherein the annular gasket retaining lip has a triangular cross-section.

4. The closure plug of claim 1, wherein the annular gasket retaining lip has a radial extension less than a radial extension of a crest of the external helical screw thread.

5. The closure plug of claim 1, wherein a diameter of the inner root is less than a diameter of a root of the external helical screw thread.

6. The closure plug of claim 1, wherein the plug is formed substantially from metal.

7. The closure plug of claim 1, wherein the plug is formed substantially from plastic resin.

8. The closure plug of claim 1, further comprising:

a resilient sealing gasket disposed on the annular gasket seat.

9. The closure plug of claim 8, wherein the sealing gasket is selected from a material consisting of E.P.D.M., black nitrile, and P.E.

10. A closure plug, comprising:

a cylindrical sidewall having an external helical screw thread;

a circumferentially enlarged plug rim;

an annular plug gasket seat immediately under the plug rim; and, a continuous, circumferential, radially outwardly extending gasket retaining lip below the plug gasket seat, said gasket retaining lip having an inner root and an upper flank forming a continuous peripheral axially upwardly and radially outwardly facing annular surface above the external helical screw thread;

wherein the gasket seat flares radially outwardly and upwardly directly from the root of the gasket retaining lip to meet the plug rim.

11. The closure plug of claim 10, wherein the gasket seat is of frusto-conic shape.

12. The closure plug of claim 10, wherein the gasket retaining lip has a radial extension less than an outside radial extension of a crest of the external helical screw thread.

13. The closure plug of claim 10, wherein a diameter of an inner root of the gasket retaining lip is less than a diameter of a root of the external helical screw thread.

14. The closure plug of claim 10, wherein the plug is formed from metal or from moulded synthetic plastic resin.

15. The closure plug of claim 10, wherein a resilient sealing gasket is stretched onto the gasket seat and assumes the shape of the gasket seat.

16. The closure plug of claim 15, wherein the gasket seat is of frusto-conic shape and wherein the resilient sealing gasket assumes the frusto-conic shape of the gasket seat.

17. The closure plug of claim 15, wherein the sealing gasket is E.P.D.M., black nitrile or P.E.

18. A closure plug in an opening defined by a container wall with a bushing, comprising:

a closure plug having:

a cylindrical sidewall having an external helical screw thread;

an annular gasket retaining lip interposed between an annular plug gasket seat and the external helical screw thread, the annular gasket retaining lip having an inner root and an upper flank forming a continuous peripheral axially upwardly and radially outwardly facing annular surface above the external helical screw thread;

the annular gasket seat extending directly from the inner root radially outwardly and upwards in a direction away from the annular gasket retaining lip;

a resilient sealing gasket disposed on the annular gasket seat; and said bushing having a cylindrical wall with an internal helical screw thread and an upwardly extending, smooth gasket sealing area, the sealing gasket being substantially radially compressed between the bushing gasket sealing area and the plug annular gasket seat and lying in close proximity to the bushing internal helical screw thread.

* * * * *